US011105111B2

(12) United States Patent
Lee et al.

(10) Patent No.: US 11,105,111 B2
(45) Date of Patent: Aug. 31, 2021

(54) BUTTRESS ASSEMBLY FOR SEISMIC REINFORCING OF BUILDING HAVING NON-BEARING WALLS

(71) Applicant: Industry-Academic Cooperation Foundation, Dankook University, Gyeonggi-do (KR)

(72) Inventors: Sang Hyun Lee, Gyeonggi-do (KR); Taesung Eom, Gyeonggi-do (KR); Moo-Won Hur, Seoul (KR); Ji Eun Roh, Gyeonggi-do (KR)

(73) Assignee: Industry-Academic Cooperation Foundation, Dankook University, Gyeonggi-Do (KR)

( * ) Notice: Subject to any disclaimer, the term of this patent is extended or adjusted under 35 U.S.C. 154(b) by 26 days.

(21) Appl. No.: 16/654,317

(22) Filed: Oct. 16, 2019

(65) Prior Publication Data

US 2021/0017783 A1 Jan. 21, 2021

(30) Foreign Application Priority Data

Jul. 15, 2019 (KR) ..... 10-2019-0085263

(51) Int. Cl.
*E04B 1/98* (2006.01)
*E04H 9/02* (2006.01)

(52) U.S. Cl.
CPC ..... *E04H 9/024* (2013.01); *E04B 1/98* (2013.01); *E04H 9/025* (2013.01)

(58) Field of Classification Search
CPC ..... E04B 1/92; E04B 1/98; E04H 9/00; E04H 9/02; E04H 9/021; E04H 9/024; E04H 9/025; E04H 9/027; E04G 23/0218; E04G 23/0237
See application file for complete search history.

(56) References Cited

U.S. PATENT DOCUMENTS 10,794,078 B2 * 10/2020 Lee ..... E04H 9/021
2008/0229684 A1 * 9/2008 Joung ..... E04H 9/02 52/167.4
2014/0059951 A1 * 3/2014 Balducci ..... E04H 9/02 52/167.4
2021/0131092 A1 * 5/2021 Borwankar ..... E04G 23/0237

FOREIGN PATENT DOCUMENTS

CN 106978932 A * 7/2017
CN 107152097 A * 9/2017
CN 107476461 A * 12/2017
(Continued)

OTHER PUBLICATIONS

Machine Translation of KR101814415; http://engpat.kipris.or.kr/pmt/patent/patentRTT.jsp; Jan. 5, 2021 (Year: 2021).*

*Primary Examiner* — Ryan D Kwiecinski
(74) *Attorney, Agent, or Firm* — Fay Kaplun & Marcin, LLP

(57) ABSTRACT

Disclosed is a buttress assembly located outside side walls comprising non-bearing walls located in a long side direction of an existing building and comprising concrete, the buttress assembly including a plurality of reinforcing steel structures extending in a short side direction of the existing building, connected to the existing building by anchors, and arranged in a vertical direction of the side walls.

6 Claims, 6 Drawing Sheets

(56) References Cited

FOREIGN PATENT DOCUMENTS

| | | | | | |
|---|---|---|---|---|---|
| CN | 108842910 | A | * | 11/2018 | |
| CN | 111305379 | A | * | 6/2020 | |
| CN | 111335718 | A | * | 6/2020 | |
| JP | H1130045 | | | 2/1999 | |
| JP | H1181703 | | | 3/1999 | |
| JP | 2009/249851 | | | 10/2009 | |
| KR | 2011/0001392 | | | 1/2011 | |
| KR | 10-2013-0018343 | | | 2/2013 | |
| KR | 20130018343 | A | * | 2/2013 | |
| KR | 1814415 | B1 | * | 1/2018 | |
| KR | 1828265 | B1 | * | 2/2018 | |
| KR | 1880494 | B1 | * | 8/2018 | |
| KR | 2018137268 | A | * | 12/2018 | |
| KR | 1990006 | B1 | * | 6/2019 | |
| WO | WO-2018070634 | A1 | * | 4/2018 | ..... E04H 9/021 |

* cited by examiner

BUTTRESS ASSEMBLY FOR SEISMIC REINFORCING OF BUILDING HAVING NON-BEARING WALLS

CROSS-REFERENCE TO RELATED APPLICATIONS

The present disclosure claims priority to Korean Patent Application Serial No. 10-2019-0085263 in the Republic of Korea, the disclosure of which is incorporated herein by reference.

FIELD

The present disclosure relates to a buttress assembly for seismic reinforcement of a building having non-bearing walls.

BACKGROUND INFORMATION

A building designed without anti-vibration performance as a building having a general wall type or plate-shaped structure cannot endure a high earthquake load, and seismic reinforcement is performed on the building. In particular, buildings such as old (aged) apartments urgently require seismic reinforcement. This is because reinforcing against seismic loads are necessary because an anti-vibration design is not implemented.

However, if seismic reinforcement is performed in a general method in a residential complex such as an apartment, residents need to move out because the seismic reinforcement has to be performed in the interiors, and the move-out period is also long because the basic construction is complex.

The relevant conventional technologies will be discussed.

Japanese Patent Application Publication No. 1999-081703 relates to an external seismic reinforcing method considering a disaster measure, provides an external seismic reinforcing method that can perform construction while the residents of a building reside, and relates to an external seismic reinforcing method that constructs reinforcing structures 2 on opposite side surfaces of an existing building 1.

The residents of the existing building do not have to move out, but a detailed performance of seismic reinforcement has not been proven, and it will not have sufficient seismic reinforcement with the suggested reinforcing structure and it is necessary to have a foundation construction.

PRIOR TECHNICAL DOCUMENTS (Patent document 1) JP 1999-081703 A
(Patent document 2) JP 1999-030045 A
(Patent Document 3) KR 10-2013-0018343 A

SUMMARY

The present disclosure relates to not having favorable constructability due to a complexity of basic construction when reinforcing a short side direction in order to provide the seismic reinforcement to an existing building without earthquake-resistance and to residents having to move out.

In particular, the present disclosure relates to the problem caused when buttresses are installed due to the structural limit of the non-bearing walls in the building including non-bearing walls.

According to the present disclosure, a buttress assembly 100 located outside side walls including non-bearing walls

12 located in a long side direction of an existing building 10 and including concrete, includes a plurality of reinforcing steel structures 200 extending in a short side direction of the existing building 10, connected to the existing building 10 by anchors 201, and arranged in a vertical direction of the side walls.

Further, the existing building 10 may be a framed building, and vertical locations of the reinforcing steel structures 200 correspond to locations of slabs 14 or beams 15 that supports upper and lower sides of the non-bearing walls 12 of the existing building 10.

Further, the anchors 201 may be coupled to the slabs 14 or the beams 15 of the existing building 10.

The buttress assembly may further include a plurality of reinforcement arranging members 300 that are reinforcements.

Further, the reinforcing steel structures 200 may include webs 210 disposed in the long side direction and flanges 220 disposed vertically, openings 215 for reinforcements are located in the webs 210, the reinforcement arranging members 300 may include a plurality of main reinforcements 310 arranged to extend vertically, and some of the plurality of main reinforcements 310 may pass through the openings 215 for reinforcements.

Further, the reinforcing steel structures 200 are honeycomb beams, the honeycomb beams may be divided into a first member 200A and a second member 200B by separating the webs into semi-hexagonal shapes, the first member 200A and the second member 200B may cross each other after being separated such that portions of the separated interfaces contact each other, other portions of the separated interfaces may form hexagonal openings by welding the contacting portions, and the hexagonal openings may be the openings 215 for reinforcements.

Further, the reinforcement arranging member 300 may include a plurality of tie reinforcements 330 arranged vertically at a predetermined interval, having a rectangular shape, and having openings toward the existing building 10; a plurality of U-shaped reinforcing reinforcements 320 provided in the respective tie reinforcements 330, and opened toward the openings; and a plurality of main reinforcements 310 located at inner corners of the tie reinforcements 330 and the reinforcing reinforcements 320.

The present disclosure provides a buttress assembly installed in a slab or a beam as in the second embodiment, instead of a buttress assembly installed in a bearing wall as in the first embodiment. This has the following advantages.

Similarly to the first embodiment, if the seismic reinforcement is performed in the long side direction of the existing building, separation between adjacent buildings in the existing building site is maintained, the basic construction is simplified, the constructability is obtained, and the residents do not need to move out.

Meanwhile, as compared with the first embodiment, it may be utilized in a framed building as well as in a wall type structure building. The number of punches that are necessary for the side walls is reduced by reducing the number of used anchors by utilizing anchor of sufficiently large diameters, and construction perfoioiance is further increased. The structural strength is increased by utilizing the webs of the reinforcing steel structure. The shear force can be secured without reinforcing the interface portions.

BRIEF DESCRIPTION OF THE DRAWINGS

The above and other objects, features, and advantages of the present disclosure will be more apparent from the following detailed description taken in conjunction with the accompanying drawings, in which.

DETAILED DESCRIPTION

Hereinafter, an 'existing building 10' may be any building that requires a seismic reinforcement without limitation, but in an embodiment, may be a wall type building or a plate-shaped building. However, in order to determine a 'long side direction', which will be described below, a non-rectangular building, in which the ratio of the transverse length to the longitudinal length is not 1, is assumed.

Figure 1:
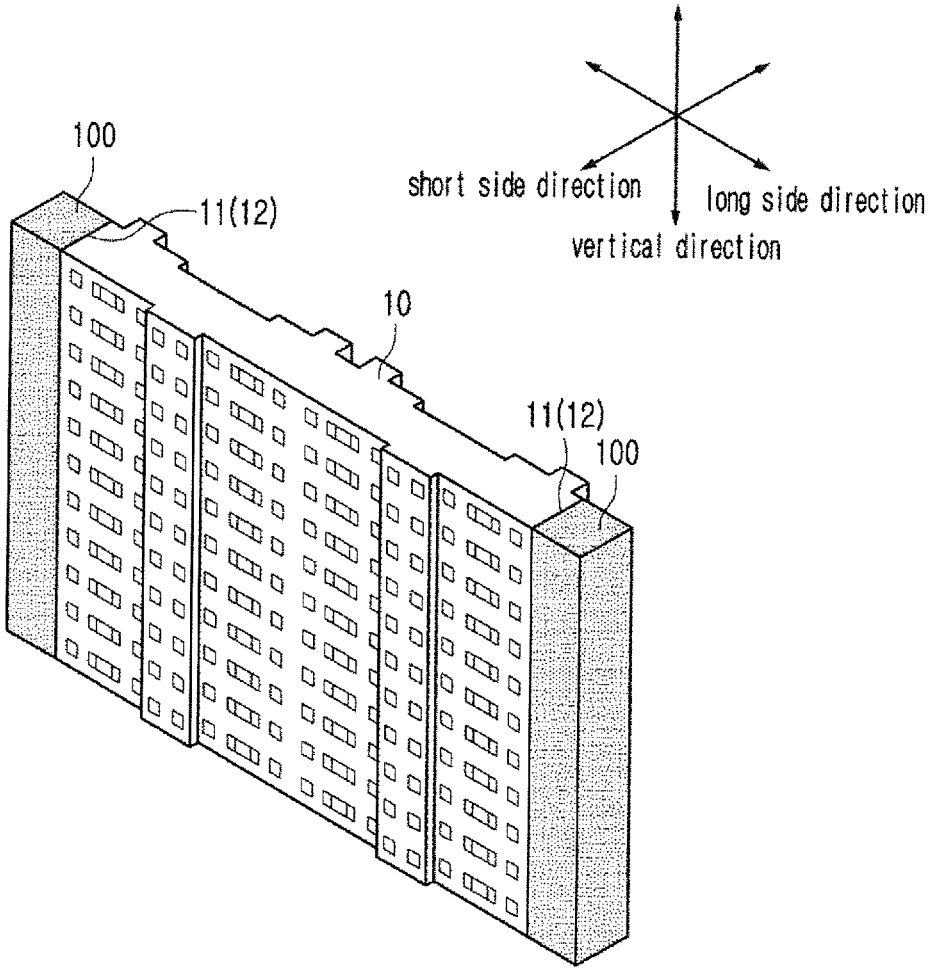
FIG. 1 illustrates a buttress assembly installed in an existing building according to the present disclosure.

Hereinafter, the 'long side direction' refers to a direction that extends toward opposite side walls with respect to the existing building 10, and the 'short side direction' refers to a direction that extends the front surface and the rear surface of the existing building 10 with respect to the existing building 10 (see FIG. 1).

Hereinafter, a 'vertical direction' refers to a height of the existing building 10, that is, a lengthwise direction that extends upwards and downwards.

Hereinafter, a buttress assembly according to the present disclosure will be described in detail with reference to the drawings. Here, the elements constituting the present disclosure may be integrally used or separately used as occasional demands. Further, some elements may be omitted according to the usage of the pure oxygen direct combustion system. The form of the present disclosure and the number of the elements may be also variously modified.

Description of First Embodiment

A first embodiment of the present disclosure will be described with reference to FIGS. 1 to 4. In the first embodiment, an existing building 10 is a wall type structure, and opposite side walls are bearing walls 11.

Buttress assemblies 100 are installed on the bearing walls 11 that are opposite side walls of the existing building 10. That is, the building 10 is seismically reinforced in a long side direction. Because a structure, such as a separate buttress, is not installed in a short side direction, that is, there is no interior construction, the buttress assemblies 100 can be constructed even though residents do not move out. Further, because the building does not become larger in the short side direction, the separation between adjacent buildings does not decrease in the site of the existing building 10.

The detailed design (the size of the buttress assembly, the arrangement of reinforcements, and the like) of the buttress assemblies 100 is based on the state of the existing building 10 and a predicted earthquake-based shear force or moment. In an embodiment, the length of the buttress assembly 100 may be 8 m, and the thickness of the buttress assembly 100 may be 600 mm.

It is noted that the side walls, in which the buttress assemblies 100 are installed, are bearing walls 11. The bearing walls 11 have a sufficient depth such that long anchors 201 may be used.

That is, the locations of the anchors 201 that couple reinforcing steel structures 200 are not limited as long as the side walls of the existing building 10 are the bearing walls 11, and the number of the anchors 201 may be determined to be sufficient as desired and the insertion depths of the anchors 201 may be sufficiently determined. Accordingly, the reinforcing steel structures 200 are disposed to extend in a vertical direction of the existing building 10, and a plurality of reinforcing steel structures 200 are arranged in the short side direction.

Figure 2:
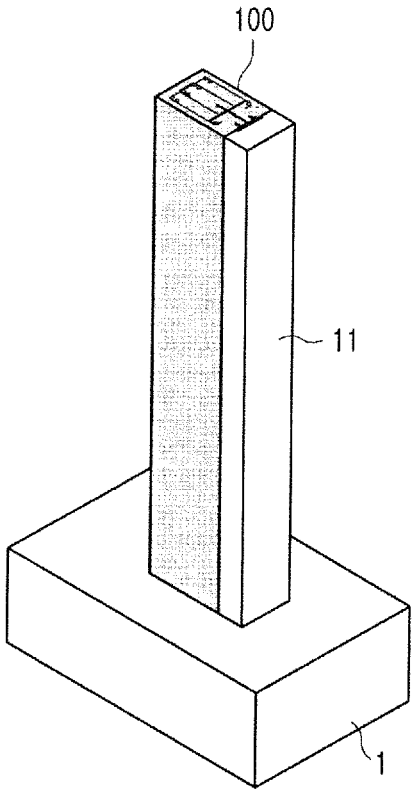
FIG. 2 illustrates a schematic perspective view of a buttress assembly according to a first embodiment of the present disclosure.
Figure 3:
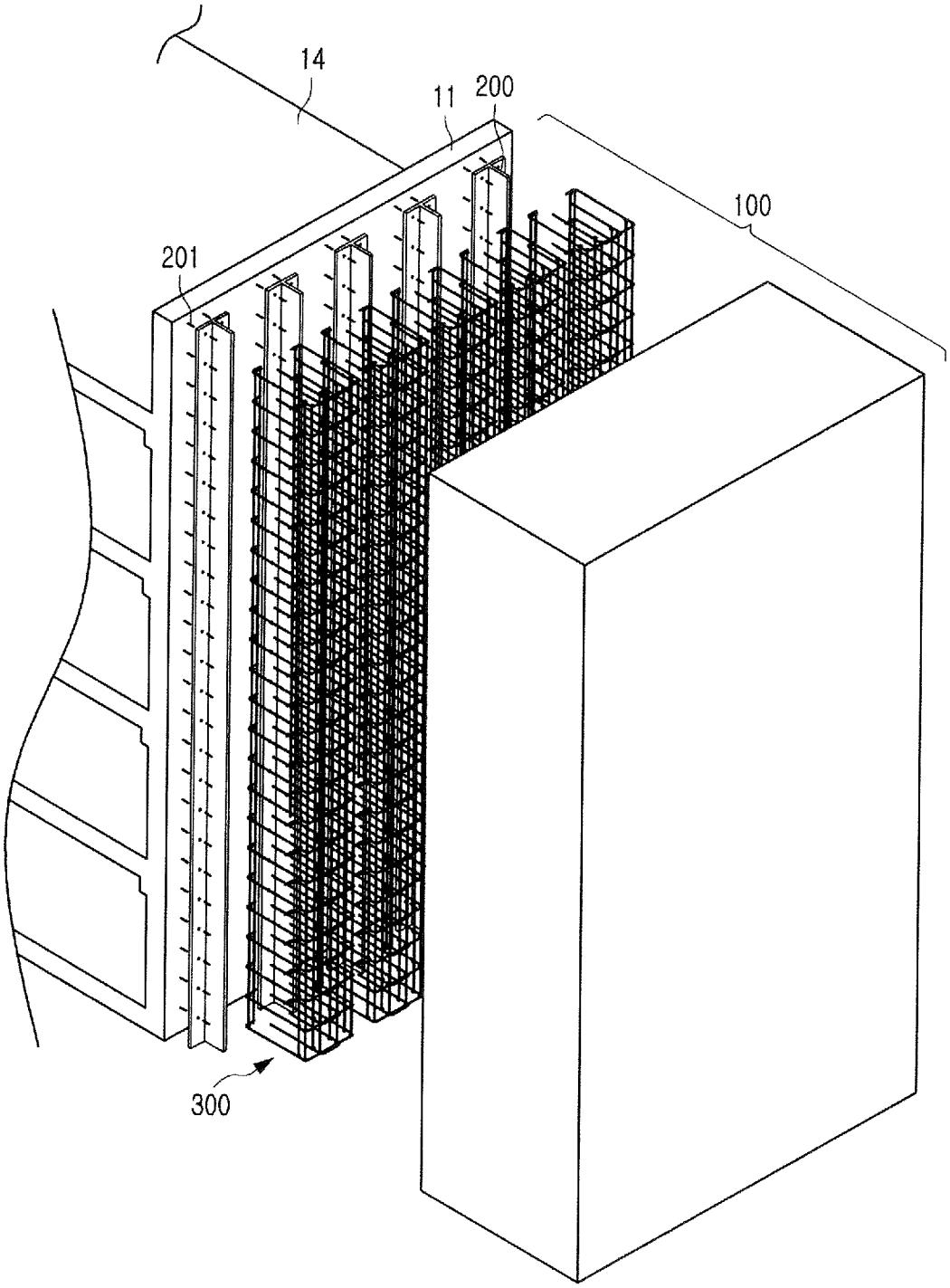
FIG. 3 illustrates a schematic exploded perspective view of the buttress assembly according to the first embodiment of the present disclosure, in which in order to help understanding of a reinforcing steel structure(s), it should be noted that a concrete part is illustrated separately from a reinforcing steel structure(s) and a reinforcement arranging member.

A detailed description will be made with further reference to FIGS. 2 and 3. Even though a concrete mass part, the reinforcing steel structures 200, and the reinforcement arranging members 300 are illustrated separately in FIG. 3, it should be noted that concrete is cured such that they are integrally formed.

The reinforcing steel structures 200 having a web and a flange, as in a T-shaped steel or a H-shaped steel, extend in a vertical direction of the existing building 10, and a plurality of reinforcing steel structures 200 are arranged in the short side direction. The flange parts are anchored. Further, reinforcement arranging members 300 are provided for the respective reinforcing steel structures 200.

Figure 4:
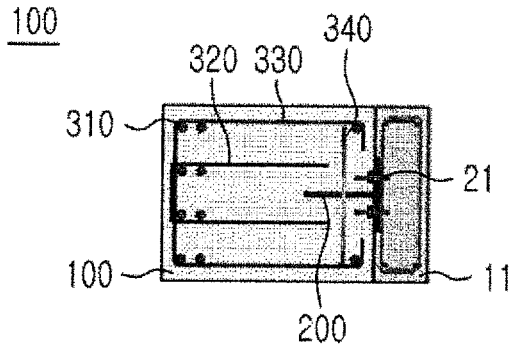
FIG. 4 illustrates a view of arrangement of reinforcements of the buttress assembly according to the first embodiment of the present disclosure.

As illustrated in FIG. 4, each of the reinforcement arranging members 300 may include: a plurality of tie reinforcements 330 arranged vertically at a predetermined interval, having a rectangular shape, and each having an opening part toward the existing building 10; a plurality of U-shaped reinforcing reinforcements 320 provided in the respective tie reinforcements 330 and opened toward the corresponding opening parts; and a plurality of reinforcements 310 located at inner corners of the tie reinforcements 330 and the reinforcing reinforcements 320. Dowel reinforcements 340 toward the opening parts may be further provided.

Description of Second Embodiment

Figure 5:
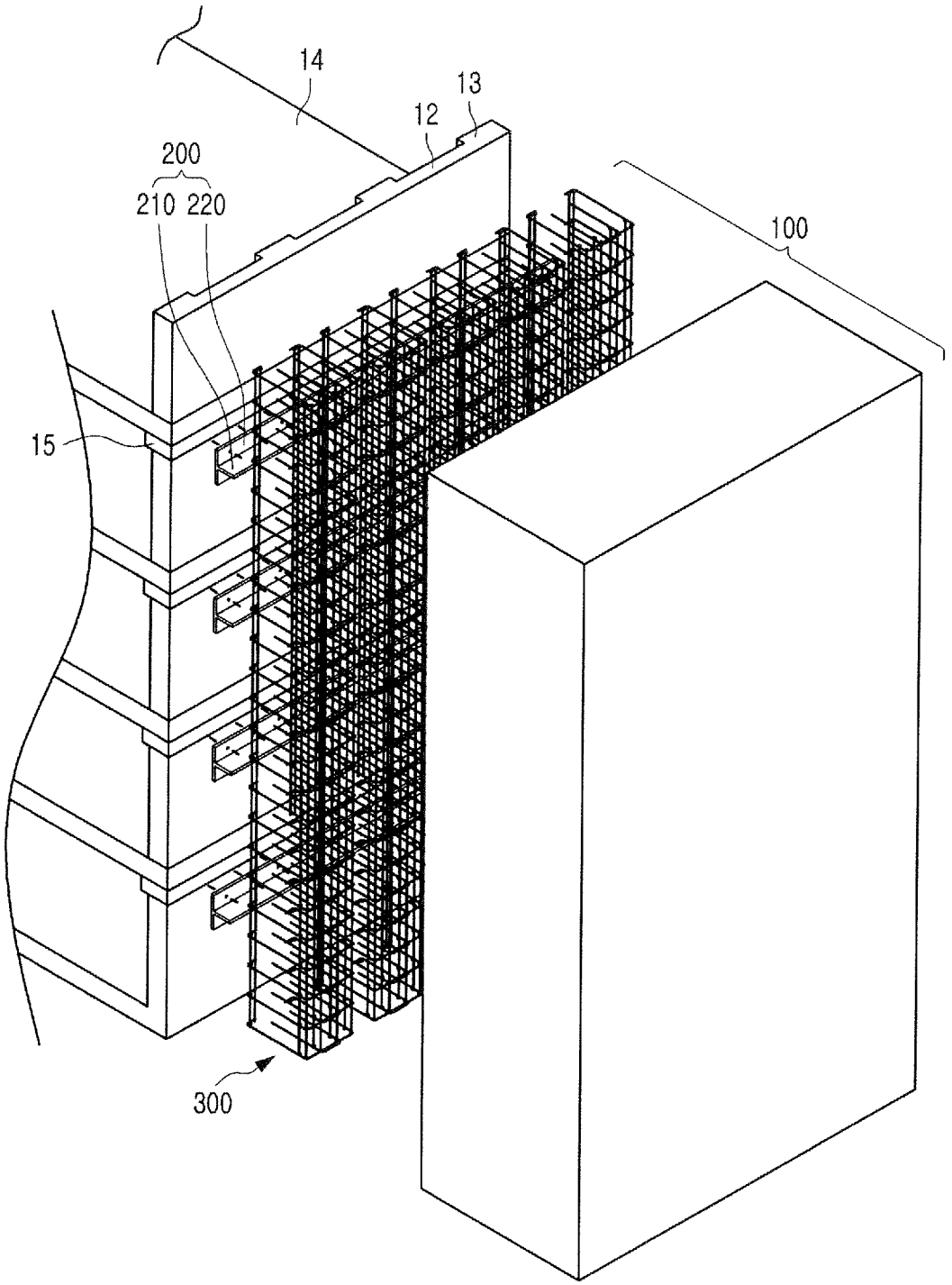
FIG. 5 illustrates a schematic exploded perspective view of a buttress assembly according to a second embodiment of the present disclosure, in which similarly to FIG. 3, in order to help understanding of a reinforcing steel structure(s), it should be noted that a concrete part is illustrated separately from a reinforcing steel structure(s) and a reinforcement arranging member.

A second embodiment of the present disclosure will be described with reference to FIGS. 5 to 7. The second embodiment corresponds to a case in which the existing building 10 is a framed structure (a building including a column 13, a slab 14, and a beam 15), and the side walls except for the column, the slab, and the beam are relatively thin non-bearing walls 12.

Similarly to the first embodiment, the second embodiment corresponds to buttress assemblies 100 installed in the long side direction, and residents do not have to move out while the separation between the adjacent buildings are not reduced and seismic reinforcement is achieved as well.

However, the thickness of the non-bearing walls 12 is thin as compared with the bearing walls 11 of the first embodiment when the second embodiment is applied in the same way as the method of the first embodiment, it is difficult to secure the insertion lengths of the anchors 201 so that the anchors having small sizes (lengths and diameters) have to be used. Accordingly, a larger number of anchors 201 have to be coupled for securing necessary bearings of the buttress assemblies 100 in the same condition, and it is also necessary to reinforce the interfaces between the non-bearing walls 12 and the buttress assemblies 100. Accordingly, the construction performance is not good, and other structural problems may be caused.

To solve this, in the second embodiment, the extension directions of the reinforcing steel structures 200 are rotated by 90 degrees in the first embodiment. As illustrated in FIG. 5, the reinforcing steel structures 200 extend in the short side direction of the existing building 10, and a plurality of reinforcing steel structures 200 are arranged in the vertical direction of the side walls including the non-bearing walls 12.

The vertical locations of the reinforcing steel structures 200 extending in the short side direction have to be locations of the slabs 14 or the beams 15 of the existing building 10. That is, the reinforcing steel structures 200 have to be located at locations corresponding to the locations of the slabs 14 and the beams 15 such that the anchors 201 of a sufficient insertion length are used in the slabs 14 or the beams 15 of the existing building 10.

As the reinforcing steel structures 200 are located vertically, the reinforcement arrangement of a new buttress can be easily performed, and this is because the reinforcing steel structures 200 may perform a structural function, in detail, a function of preventing the new buttress from being withdrawn when it is tensioned and compressed.

Each of the reinforcing steel structures 200 extending in the short side direction includes a web 210 that extends in the long side direction, and a flange 220 that extends vertically. A T-shaped steel will have one flange 220, and an H-shaped steel will have two flanges 220. Here, because the flange 220 is coupled to the slab 14 or the beam 15 by anchors 201, the location of the flange 220 corresponds to the location of the slab 14 or the beam 15. If expressed differently, the anchors 201 are coupled to the slabs 14 or the beams 15 of the existing building 10.

With the structure, it is possible to use larger anchors (length and diameter) than in the first embodiment. It becomes possible to use anchors having a diameter that is larger than the thickness of the bearing walls 11 of the first embodiment. Accordingly, as the total number of the anchors decreases, the number of anchoring punches that are necessary for the side walls decreases and the construction performance also increases.

Meanwhile, the reinforcement arranging numbers 300 of the second embodiment are similar to those of the first embodiment. That is, each of the reinforcement arranging members 300 of the second embodiment also may include: a plurality of tie reinforcements 330 arranged vertically at a predetermined interval, having a rectangular shape, and each having an opening part toward the existing building 10; a plurality of U-shaped reinforcing reinforcements 320 provided in the respective tie reinforcements 330 and opened toward the corresponding opening parts; and a plurality of reinforcements 310 located at inner corners of the tie reinforcements 330 and the reinforcing reinforcements 320. Dowel reinforcements 340 toward the opening parts may be further provided.

Figure 6:
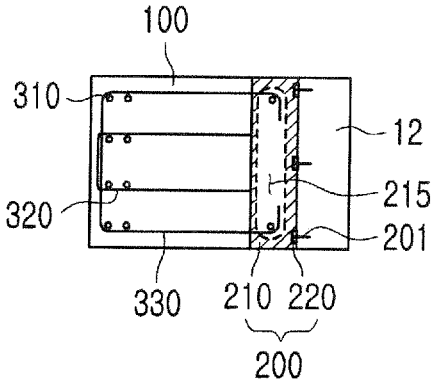
FIG. 6 illustrates a view of arrangement of reinforcements of the buttress assembly according to the second embodiment of the present disclosure.

As illustrated in FIG. 6, openings 215 for reinforcements, through which some of the main reinforcements 310 pass, have to be punched in the webs 210 of the reinforcing steel structures 200. The openings 215 for reinforcements may be punched separately or may be naturally formed by using honeycomb beams. This is in contrast with the first embodiment in which the web portions of the reinforcing steel structures 200 are not utilized at all, and helps greatly the anti-vibration performance and reinforcing of the structure.

Figure 7:
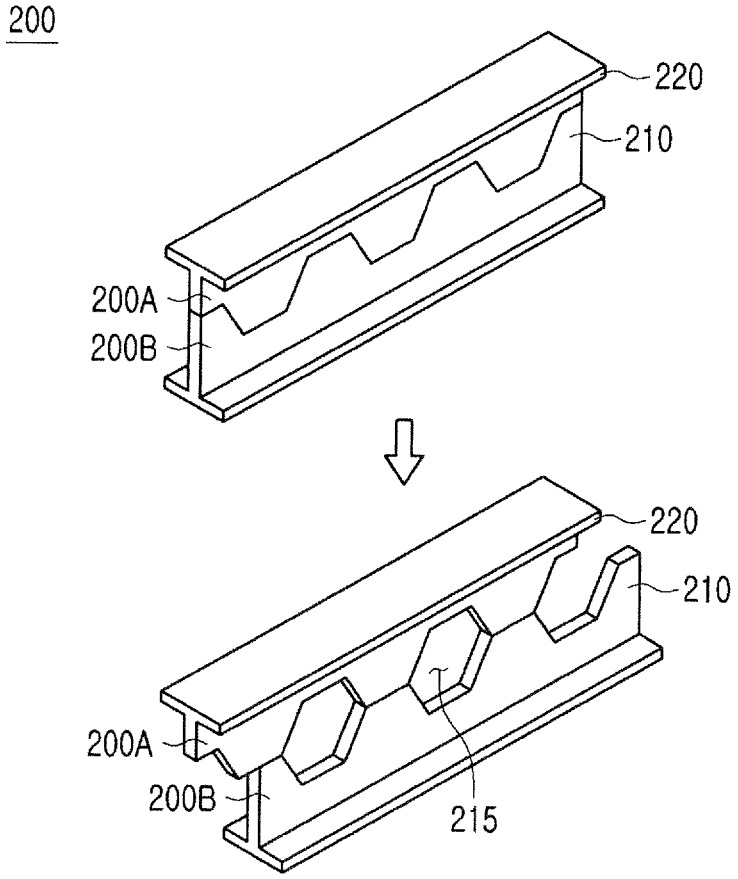
FIG. 7 illustrates an embodiment of the reinforcing steel structure(s) that may be used in the buttress assembly according to the second embodiment of the present disclosure.

FIG. 7 illustrates a honeycomb beam. As illustrated in the upper drawing, the honeycomb beam includes a first member 200A and a second member 200B that is divided by separating the web into semi-hexagonal shapes. Then, as illustrated in the lower drawings, the first member 200A and the second member 200B cross each other after being separated such that portions of the separated interfaces contact each other, other portions of the separated interfaces form hexagonal openings by welding the contacting portions, and the hexagonal openings are the openings 215 for reinforcements.

In this way, seismic reinforcement using the buttress assemblies 100 are made possible in the framed buildings, instead of wall type structures having bearing walls, by simply converting the arrangement direction of the reinforcing steel structures 200 to 90 degrees. Even though the non-bearing walls are thinner than the bearing walls, the structural performance rather increases and the construction performance is enhanced.

Although the embodiments illustrated in the drawings have been described in the specification for reference such that a person skilled in the art can easily understand and realize the present disclosure, they are merely exemplary and a person skilled in the art can understand that various modifications and equivalent embodiments are also made from the embodiments of the present disclosure. Accordingly, the scope of the present disclosure should be determined by the claims.

DESCRIPTION OF REFERENCE NUMERALS

10: Existing building
11: Bearing wall
12: Non-bearing wall
13: Column
14: Slab
15: Beam
100: Buttress assembly
200: Reinforcing steel structure
201: Anchor
210: Web
215: Opening for reinforcement
220: Flange
300: Reinforcement arranging member
310: Main reinforcement
320: Reinforcing reinforcement
330: Tie reinforcement
340: Dowel reinforcement

What is claimed is:

1. A buttress assembly located outside side walls comprising non-bearing walls located in a long side direction of an existing building and comprising concrete, the buttress assembly comprising:

a plurality of reinforcing steel structures extending in a short side direction of the existing building, connected to the existing building by anchors, and arranged in a vertical direction of the side walls, wherein the reinforcing steel structures comprise webs disposed in the long side direction and flanges disposed vertically, openings for reinforcements are located in the webs, and wherein the reinforcing steel structures are honeycomb beams, the honeycomb beams are divided into a first member and a second member by separating the webs into semi-hexagonal shapes, the first member and the second member cross each other after being separated such that portions of the separated interfaces contact each other, other portions of the separated interfaces form hexagonal openings by welding the contacting portions, and the hexagonal openings are the openings for reinforcements.

2. The buttress assembly of claim 1, wherein the existing building is a framed building, and vertical locations of the reinforcing steel structures correspond to locations of slabs or beams that supports upper and lower sides of the non-bearing walls of the existing building.

3. The buttress assembly of claim 2, wherein the anchors are coupled to the slabs or the beams of the existing building.

4. The buttress assembly of claim 1, further comprising:

a plurality of reinforcement arranging members that are reinforcements.

5. The buttress assembly of claim 4, wherein the reinforcement arranging members comprise a plurality of main reinforcements arranged to extend vertically, and some of the plurality of main reinforcements pass through the openings for reinforcements.

6. A buttress assembly located outside side walls comprising non-bearing walls located in a long side direction of an existing building and comprising concrete, the buttress assembly comprising:

a plurality of reinforcing steel structures extending in a short side direction of the existing building, connected to the existing building by anchors, and arranged in a vertical direction of the side walls; and a plurality of reinforcement arranging members that are reinforcements, wherein each of the reinforcement arranging members comprises:

a plurality of tie reinforcements arranged vertically at a predetermined interval, having a rectangular shape, and having openings toward the existing building;

a plurality of U-shaped reinforcing reinforcements provided in the respective tie reinforcements, and opened toward the openings; and a plurality of main reinforcements located at inner corners of the tie reinforcements and the reinforcing reinforcements.

* * * * *